US005730213A

United States Patent [19]

Kiser et al.

[11] Patent Number: 5,730,213

[45] Date of Patent: Mar. 24, 1998

[54] COOLING TUBE FOR HEAT EXCHANGER

[75] Inventors: Carl E. Kiser, Redondo Beach; Richard P. Beldam, Torrance, both of Calif.

[73] Assignee: AlliedSignal, Inc., Morristown, N.J.

[21] Appl. No.: 554,953

[22] Filed: Nov. 13, 1995

[51] Int. Cl.[6] ..... F28D 1/04; F28F 1/42

[52] U.S. Cl. ..... 165/148; 165/109.1; 165/177; 165/179

[58] Field of Search ..... 165/109.1, 179, 165/177, 170, 148

[56] References Cited

U.S. PATENT DOCUMENTS

| | | | |
|---|---|---|---|
| 1,191,681 | 7/1916 | Feldkamp | 165/148 |
| 2,017,201 | 10/1935 | Bossart et al. | 165/177 X |
| 3,757,856 | 9/1973 | Kun | 165/148 X |
| 3,810,509 | 5/1974 | Kun . | |
| 4,470,452 | 9/1984 | Rhodes | 165/179 X |
| 4,949,543 | 8/1990 | Cottone et al. . | |
| 4,951,371 | 8/1990 | Dalo et al. . | |
| 4,955,525 | 9/1990 | Kudo et al. . | |
| 5,097,891 | 3/1992 | Christensen . | |
| 5,267,624 | 12/1993 | Christensen . | |

FOREIGN PATENT DOCUMENTS

| | | | |
|---|---|---|---|
| 264076 | 11/1967 | Austria | 165/179 |
| 84097 | 3/1989 | Japan | 29/890.053 |
| 174898 | 7/1989 | Japan | 165/153 |
| 159986 | 6/1994 | Japan | 165/177 |
| 2090651 | 7/1982 | United Kingdom | 165/177 |
| 2223091 | 3/1990 | United Kingdom | 165/177 |

*Primary Examiner*—Leonard R. Leo
*Attorney, Agent, or Firm*—Felix L. Fischer

[57] ABSTRACT

A heat exchanger for use in connection with engine cooling systems is disclosed herein. The heat exchanger is typically considered a heat exchanger and comprises a plurality of rows of tubes, a pair of headers secured to the ends of the tubes in a mechanical and brazed joint for providing improved vibration and torsional stress resistance and improved durability. More specifically, the tube include a plurality of dimples or tabulators arranged in opposed or non opposed relation agitate the fluid about the primary heat transfer axis to facilitate heat transfer from the hot fluid to the tube wall.

12 Claims, 5 Drawing Sheets

COOLING TUBE FOR HEAT EXCHANGER

FIELD OF INVENTION

This invention relates generally to aluminum parallel tube heat exchangers for cooling fluids such as can be used for automotive engine applications as radiators, oil coolers and charge air coolers. The present invention provides a heat exchanger comprising a plurality of flattened aluminum cooling tubes disposed in a substantial parallel stacked relationship and spaced from each other by aluminum fins bonded to and between adjacent tubes. The aluminum plates and fins are specially constructed to maximize heat transfer between adjacent passageways formed by the tubes and the fluids flowing in these passageways.

RELATED APPLICATIONS

This application is related to U.S. patent application Ser. No. 08/554,952 filed on Nov. 13, 1995 for an Improved Tube To Header Joint and copending U.S. patent application Ser. No. 08/554,952 filed on Nov. 13, 1995 for an Improved Tank To Header Joint For Heat Exchangers filed concurrently herewith. These applications are assigned to the assignee hereof and the disclosures of these applications are incorporated by reference herein.

BACKGROUND

Engine system components are being scrutinized to reduce weight and the overall thermal load on the engine to thereby improve engine performance. Typically heat exchangers for use in automotive application such as radiators, oil coolers and charge air coolers can comprise a series of interlaced flow passages. A first hot circuit is designed to carry heat away from the engine. The furst hot circuit can for instance comprise a series of tubes flattened for increasing heat exchange surface area. A first fluid engine coolant such as a heat conductive fluid, for instance treated water or oil, flows in a first hot closed circuit from the engine to the heat exchanger intake, through the heat exchanger to an engine return. A second cooling circuit for extracting heat from the hot circuit preferably flows in an open circuit about the first circuit. The cooling circuit can comprise a series of tinned open passages disposed between the hot circuit tubes. A cooling fluid such as for instance ambient air can flow in the second circuit. These hot and cold circuits can be alternated to form a stacked array. Headers are used to connect the flattened tubes and form a portion of a closed fluid circuit. The tubes protrude through header plates and the joint between the header plate and the tube is extremely sensitive to applied stresses. Typically these heat exchangers are constructed with cooling fins sandwiched between flattened tubes. The tube header joint, in many cases, is a key factor in heat exchanger durability and life.

Fins can be disposed on the interior or exterior of the hot circuit tubes. Metal fins can be positioned between adjacent tubes to assist the transfer of heat from the fluid in the hot circuit through the tube to the cold fluid in the second circuit. The hot circuit tubes can also include hot fins projecting into the hot fluid for transferring heat from the hot fluid to the tube wall. Cooling fins can be disposed on the exterior of the tube walls and project into the cooling fluid surrounding the tube wall for transferring heat from the tube to the cooling fluid. These fins are bonded to the tubes and provide extended heat transfer area and sufficient structural support to provide pressure containment of the fluids. To minimize flow blockage, the fins are disposed in parallel with the fluid flow and define a flow path with minimum additional flow resistance. In addition, the thickness and number of fins is such to provide a maximum heat transfer area in contact with the fluid. A thin fin satisfies these requirements and many different detailed geometrys are used to best satisfy the specific requirements of any given design problem.

Automotive heat exchangers such as radiators, oil coolers and charge air coolers are subject to operational stresses induced by vibration, thermal expansion and pressure variations. Truck heat exchangers typically operate in the range of 8–12 PSI; passenger car heat exchanger typically operate in the range of 20–25 PSI; charge air coolers typically operate in the range of 30–35 PSI and oil coolers typically operate in the range 40–45 PSI.

SUMMARY OF THE INVENTION

It is therefore an object of this invention is to employ light weight aluminum materials in heat exchanger construction to thereby provide an improved and lightweight heat exchanger.

It is another object of the present invention to provide a heat exchanger comprising an array of substantially parallel aluminum tubes. Aluminum tubes offer light weight and good thermal conduction between hot and cold fluids and the tube wails. Such an aluminum tube heat exchanger exhibits improved thermal performance and significantly reduced weight when compared to a conventional metal such as brass or copper based heat exchangers.

Another object of the invention is also directed to prolonging service life by the inherent improved corrosion resistance of aluminum materials.

The present invention provides a heat exchanger comprising a plurality of flattened cooling tubes specially configured with internally directed dimpled turbulators to agitate tube flow by turbulating the flow through the tube turbulated about the Z-axis to improve heat exchange cooling by reducing the thermal resistance between the tube wall the enclosed fluid.

It is a principle object of this invention to provide an improved heat exchanger for engine applications such as a radiators, oil coolers and charge air coolers having improved aluminum cooling tubes enhanced with turbulators to significantly agitate the fluid and significantly improve the heat exchange between the hot fluid and the tube wall. The tubes can include inwardly directed dimple projections on the first and second flattened sides to agitate and disturb the fluid flow to thereby increase heat transfer to the tube walls. The dimples can be alternated to increase agitation or can be can be aligned in opposed relation from opposite tube walls to contact each other to improve the transverse strength and pressure resistance of the tubes.

As a result of the improved cooling tubes, the present invention provides for an improved heat exchanger which exhibits improved durability, stress and pressure resistance. Further with improved flow of the cooling fluid, the length of the cooling circuit needed to reduce the temperature of the compressed fluid can be shortened.

These and other objects and features will be apparent from the following specification taken in connection with the accompanying drawings in which:

In accordance with a preferred embodiment a heat exchanger can be constructed of an integrated stacked array of alternating first and second aluminum passageways of sufficient size to accomplish the desired overall transfer of heat between the two flowing fluids therethrough. A first hot circuit comprising aluminum tubes can be interlaced with a second cooling circuit comprising tinned passageways. Dimpled aluminum tubes can be disposed in substantially parallel spaced array separated by an array of corrugated aluminum fins disposed between and bonded to the tubes for supporting the first and second tubes in a stacked array.

Other objects and features of preferred embodiments of the present invention will be apparent from the following detailed description taken in connection with the accompanying drawings in which:

DESCRIPTION OF BEST MODE OF CARRYING OUT THE INVENTIONS

Figure 1:
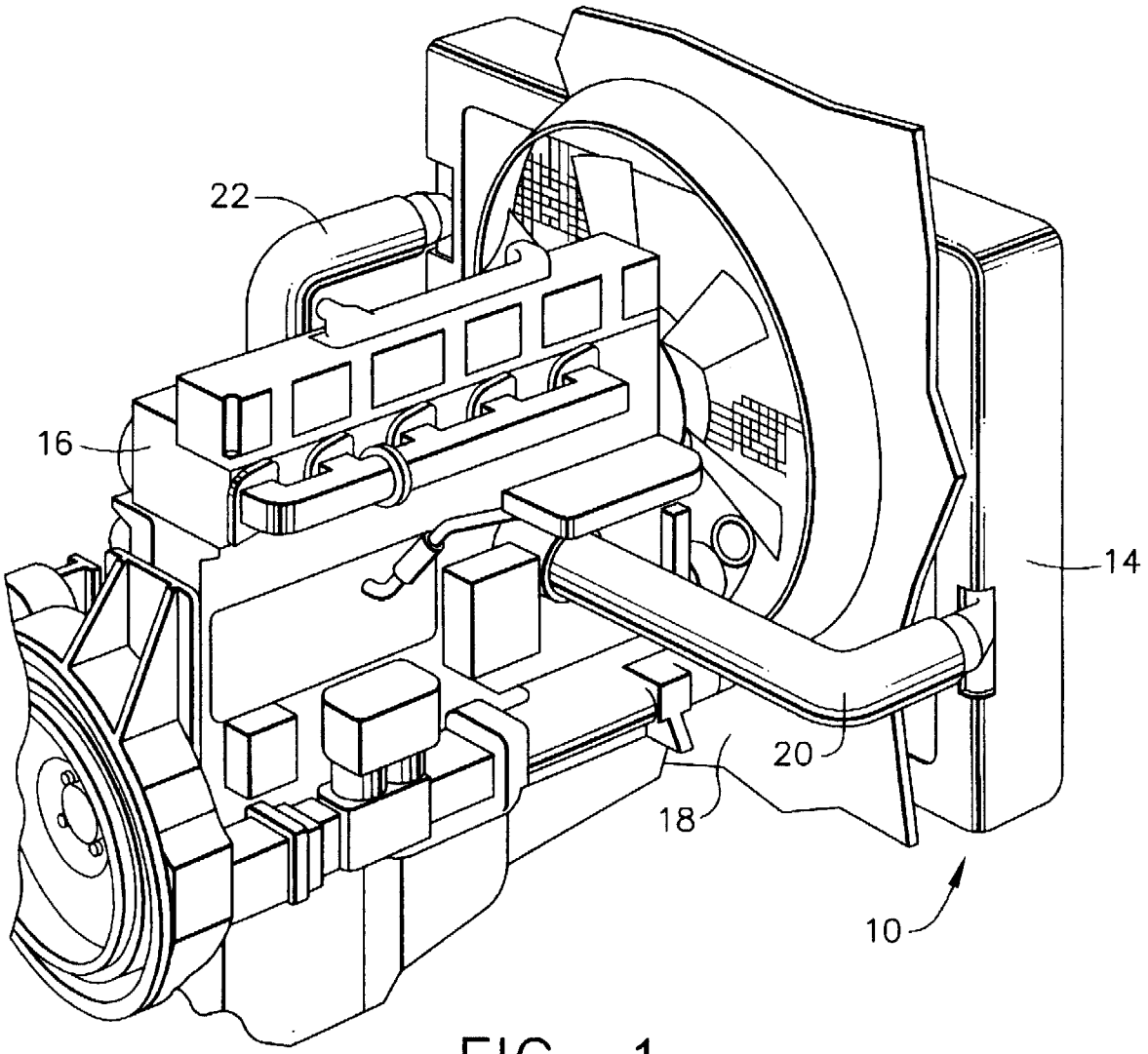
FIG. 1 is an illustration of a heat exchanger cooling system in combination with an engine system.

Referring now to FIG. 1, an illustration of a heat exchanger for an engine cooling system 10 is shown to include a heat exchanger 14 such as a radiator, oil cooler or charge air cooler in front mounted relationship with an internal combustion engine 16. Typically the heat exchanger 14 is mounted forward of the vehicle (not shown) and receives headwinds generated by vehicle movement and an associated cooling fan as well as vibrational and torsional stresses developed from vehicle and engine operation. An engine cooling circuit 18 includes a supply tube 20 coupled between the engine 16 and a hot side of the heat exchanger 14 for channeling a hot fluid from the engine 16 to the heat exchanger 14 and a return tube 22 coupled between the heat exchanger 14 and the engine 16 for channeling a cooled fluid from the exchanger 14 to the engine 16.

Figure 2:
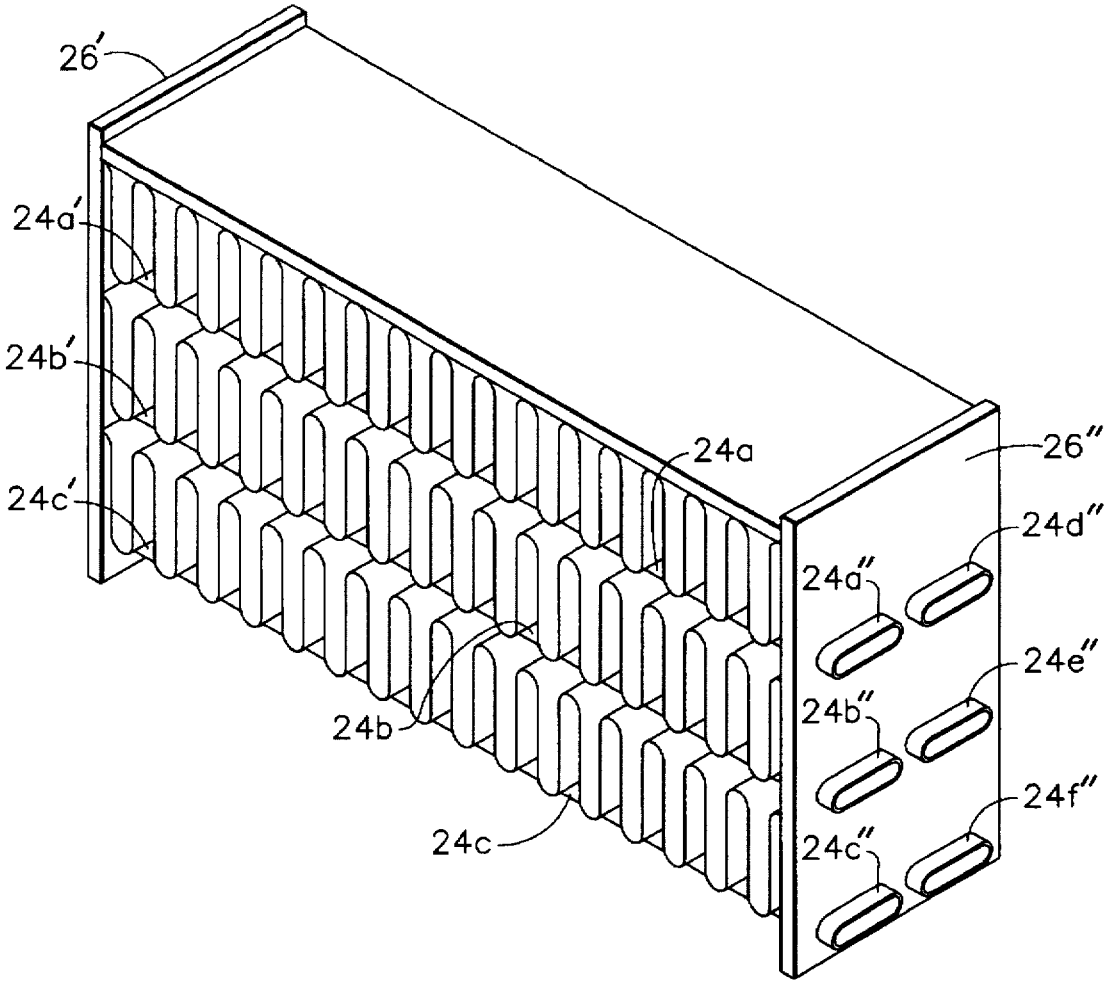
FIG. 2 is an illustration of a side perspective view of heat exchanger core.

Referring now to FIG. 2, an illustration of a schematic representation of a typical heat exchanger core 14 is shown wherein flattened aluminum tubes 24*a*, 24*b*, 24*c*, 24*d*, 24*e* and 24*f* are sealed in a jointed connected at their first and second opposite tubes ends 24*a*', 24*b*', 24*c*', 24*d*', 24*e*' and 24*f* and 24*a*", 24*b*", 24*c*", 24*d*", 24*e*" and 24*f*' respectively to header plates 26' and 26". Typically the header plates 26' and 26" can have an opening for receiving the first and second flattened tube ends 24*a*', 24*b*', 24*c*', 24*d*', 24*e*' and 24*f*' and 24*a*", 24*b*", 24*c*", 24*d*", 24*e*" and 24*f*' there through. More details of the connection between the tubes and the header plate can be found in copending U.S. patent application Ser. No. (Docket 90093001) for an Improved Tube To Header Joint, assigned to the assignee hereof and incorporated by reference herein. Aluminum fins 28 can be disposed between parallel tubes 24*a*, 24*b*, 24*c*, 24*d*, 24*e* and 24*f* to enhance heat transfer from the tubes. Side plates 30 extend between and are rigidly affixed to the header plates 26' and 26"

Figure 3:
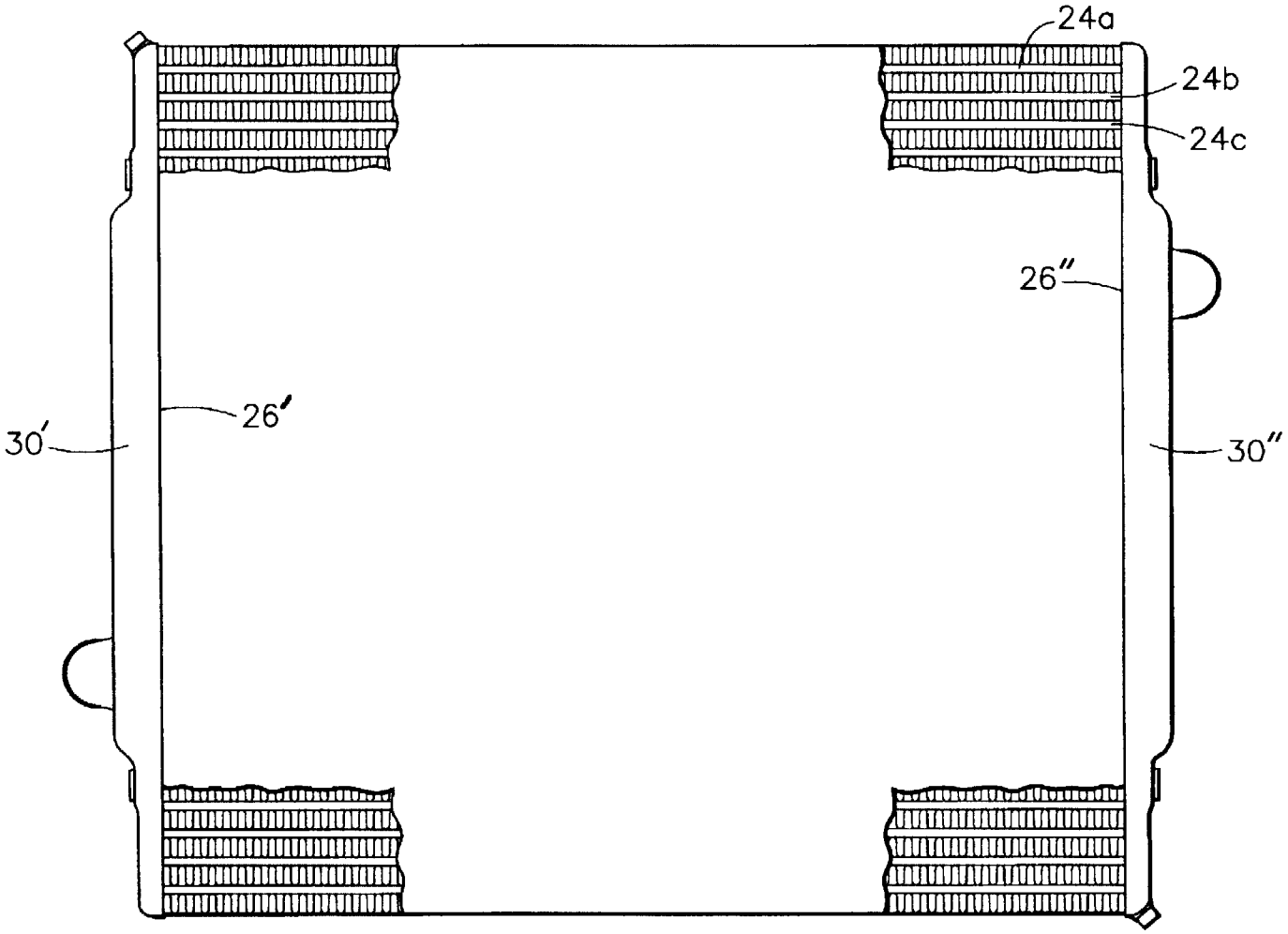
FIG. 3 is an illustration of a front elevation view of an assembled heat exchanger cooler comprising cooling tubes and header plates coupled with side tanks.

Side tanks 30' and 30" in FIG. 3, can be sealingly applied to the header plates 26' and 26" respectively to form a closed heat exchanger from the heat exchanger core of FIG. 2. Additional details of the connection between the side tanks 30' and 30" and the header plates 26' and 26" respectively can be found in copending U.S. patent application Ser. No. 08/554951 for an Improved Tank To Header Joint For Heat Exchangers, assigned to the assignee hereof and incorporated by reference herein.

Figure 4:
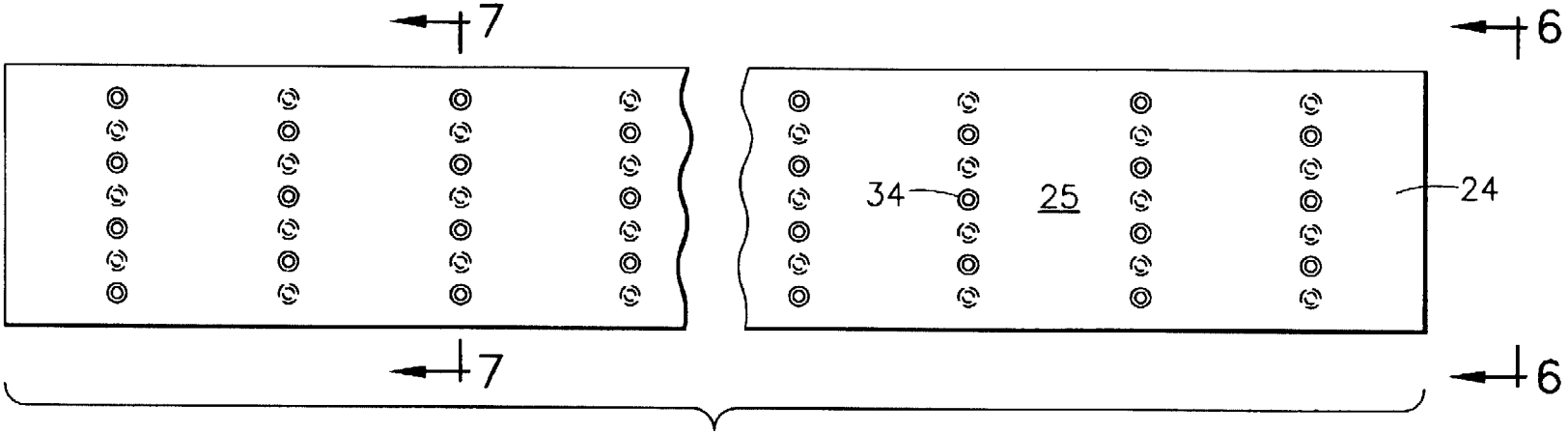
FIG. 4 is an illustration of a plan view of a flattened core tube having concave dimples in accordance with a preferred embodiment
Figure 5:
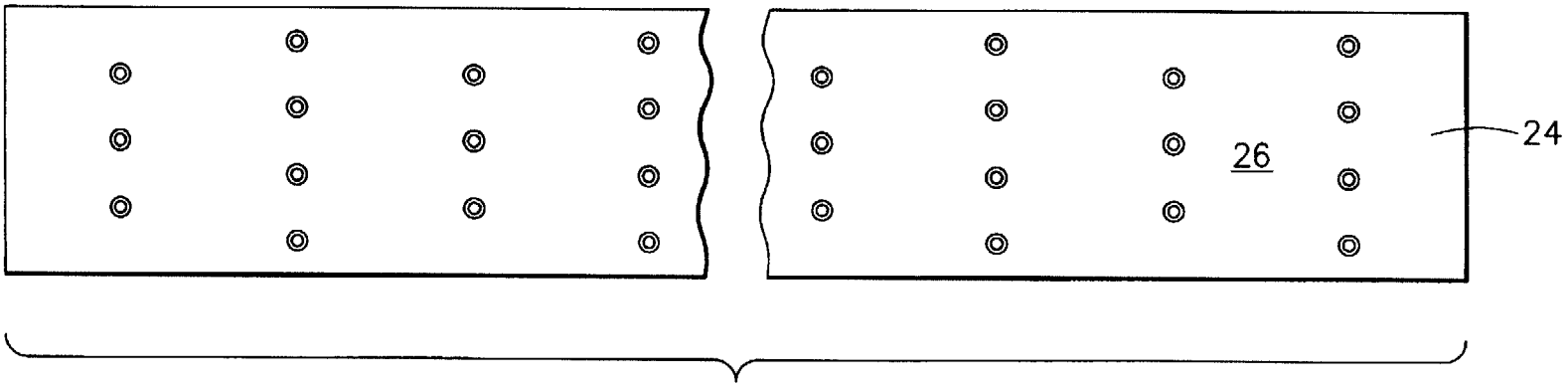
FIG. 5 is an illustration of a of a plan view of the opposite side of the flattened core tube shown in FIG. 4 having concave dimples in accordance with a preferred embodiment

An improved cooling tube 24 in accordance with the present invention is illustrated in top and bottom views in FIG. 4 and 5 wherein the flattened tube 24 is shown to include a array of inwardly projecting dimples, bumps or turbulators 34 for increasing heat transfer from the contained fluid to the tube 24 by agitating the flow of fluid through the tube 24. The illustration of FIG. 4 can be recognized to show a first or top side respectively of a flattened tube 24 provided with concave downwardly projecting dimples 34 projecting from an exterior tube surface 25 into the interior of the tube 24 for disturbing or turbulating the fluid flow within the tube to enhance heat transfer from the contained fluid to the tube wall. Similarly the illustration of FIG. 5 can be recognized to show a second or bottom side of a flattened tube 24 provided with a concave upwardly projecting dimples 34 projecting from an opposite exterior surface 26 into the interior of the tube 24 for disturbing or turbulating the fluid flow within the tube 24 to enhance heat transfer from the fluid to the tube wall. It will be appreciated by those skilled in the art that the turbulators 34 by projecting into the cross section flow area of the tube 24 create obstructions that locally divert the fluid flow and thereby induce agitation or turbulence in the fluid. In comparison of FIGS. 4 and 5 it can be seen that one or more of the dimples or turbulators 34 can be aligned with each other. It will be appreciated that the dimples 34 locally constrict the tube causing a localized pressure increase to further energize and agitate the flow. In a particularly preferred embodiment the dimples 34 can be located in oppositely disposed relation opposite each other on the upper and lower surfaces 25 and 26 respectively and can be aligned to narrow the flow path therethrough. In a particularly preferred embodiment opposed dimples 34 can contact each other to thereby improve the strength and structural rigidity of the flattened tube with the fluid flow being diverted around the restriction and the local turbulence of the fluid being increased. The dimple surfaces can be aluminum clad so that when the heat exchanger is brazed heat treated, the opposed dimples will join to form substantially cylindrical shapes. It will be further appreciated that the dimples 34 cause a turbulent fluid flow within the tube wherein fluid is prevented from developing radial temperature gradient. In a preferred illustrative embodiment, the tubes 24 can typically have a lateral width of at approximately 1–3 inches and preferably 1.5–3 inches. The tubes 24 have a cross-sectional height of approximately 0.050–0.060 inches. It is preferred that the dimples 34 be laterally spaced at intervals of approximately 0.375 inches from each other. Longitudinal dimple spacing of approximately 1 inch for 10–40 PSI fluids has been found sufficient. Spacing much closer than this has been found to substantially increase the pressure drop over the length of the tube and detract from heat exchanger performance. It has been found that tubes 24 much narrower than 1 inch lack sufficient cross section to admit an optimal array of dimples 34. Accordingly fluid flowing through such a narrowed tube, is agitated in a less than optimal manner resulting in the creation of boundary layer thermal resistance at interior surface of the tube wall. The dimples 34 in a preferred illustration can comprise indentation of depth of up to 50% of the tube cross section or typically in the range of 0.015–.0.030 inches.

Figure 6:
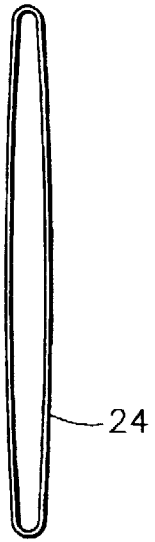
FIG. 6 is an illustration an end view of the flattened tube accordance with the present invention.

FIG. 6 illustrates an end view of the tube 24 showing the flattened tube 24 has an expanded and oversized smooth end surface for insertion within a header 26. It is preferred that the dimples 34 be recessed from the end of the tube to ensure a continuous tube to header connection.

Figure 7:
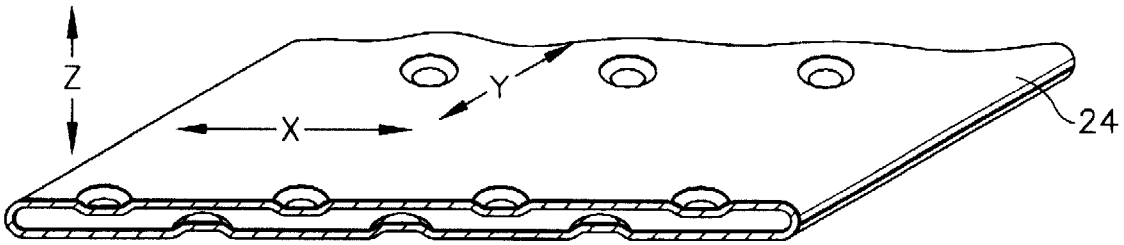
FIG. 7 is an illustration of a cross-sectional perspective view through the flattened tube in accordance with the present invention showing flow directions X, Y and Z.

FIG. 7 illustrates an end view of the flattened tube 24 that internally includes a series of dimples 34 for transferring heat from the fluid to the tube wall 24. More particularly the dimples 34 are disposed in a non opposed relation. For the purpose of discussion, the longitudinal axis is the tube is identified as the Y axis while the lateral axis is identified as the X axis. The Z axis is perpendicular to the plane formed by the x and Y axes and represents the primary axis of heat conduction within the heat exchanger.

Figure 8:
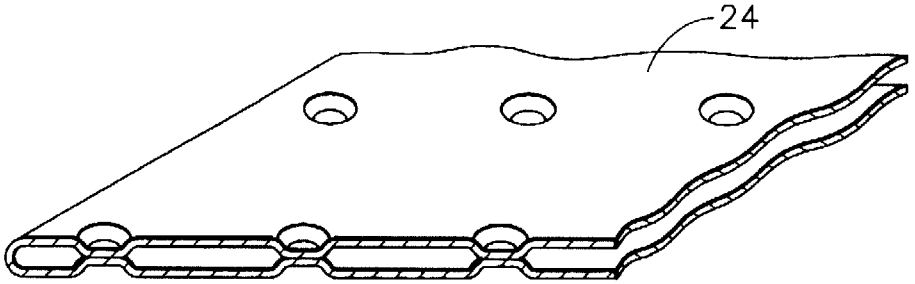
FIG. 8 is an illustration of a fragmentary cross-sectional view perspective view through the flattened tube having opposed dimples brazed to each other in accordance with the present invention.

FIG. 8 is an illustration of a fragmentary cross-sectional view perspective view through the flattened tube having opposed dimples brazed to each other in accordance with the present invention.

Figure 9:
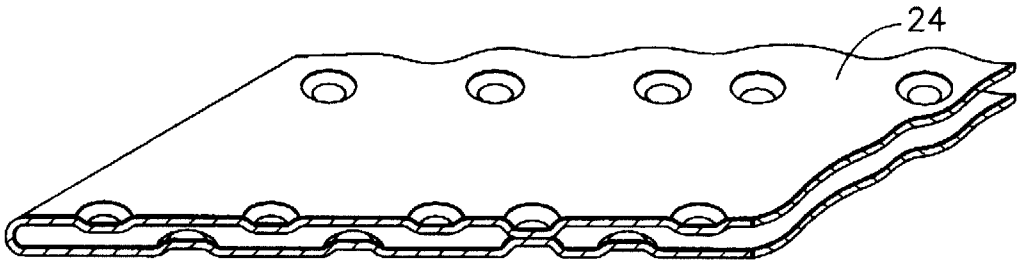
FIG. 9 is an illustration of a cross-sectional perspective view through the flattened tube having unopposed dimples and opposed dimples in accordance with the present invention.

FIG. 9 is an illustration of a cross-sectional perspective view through the flattened tube having unopposed dimples and opposed dimples in accordance with the present invention.

In operation a fluid flowing in the Y direction through a tube 24 contacts and encounters dimples 34. The fluid first separates into two streams to circumvent the dimple obstruction creating a localized region of increased turbulence as the fluid passes the dimple. After overcoming the dimples 34 the fluid streams converge in oppositly rotating vortices centered about the Z axis. The specially configured dimpled turbulators 34 agitate the fluid flow to ensure that hotter central portions of the flowing fluid mix with the boundary layers adjacent the interior tube surfaces to achieve a substantially uniform thermal cross section within the tube. Further the dimples by turbulating fluids passing through the tube 24 about the Z-axis, improve heat exchange cooling by reducing the thermal resistance between the tube wall and the enclosed fluid.

In a preferred illustration of a method of manufacture, the tube are formed of rolled aluminum sheet stock. It is preferred that the dimples 34 can be applied to aluminum sheet stock by rolling the sheet stock with a selected dimple pattern. After the dimple pattern has been applied, the sheet stock can then be rolled about the Y axis to form a flattened tube welded on edge.

The disclosed structure provides an improved heat exchanger wherein the flattened tube dimples turbulate the flow to improve heat transfer form the fluid to the tube wall.

While a preferred embodiment of the present invention has been illustrated and described, it should be apparent to those skilled in the art that numerous modifications in the illustrated embodiment can be readily made. For instance, this structure can be applied to a variety of light weight metal materials; the thickness of the metals can be altered; dimensions and configurations of the dimples can be altered to provide for improved heat transfer and the dimension and configurations of the tubes and headers can be configured to provide improved resistance to torsional and vibrational stress as well as improved durability.

The embodiments of the invention claimed as exclusive property are as follows:

1. A sealed heat exchanger for cooling a working fluid flowing therethrough comprising a sealed interconnected network of a plurality of tubes and headers.

at least one pair of headers having a plurality of tube receiving openings disposed therein for supplying and receiving a fluid to and from said tubes;

each of said tubes comprising a flat, oblong, flow-through malleable tube for insertion through said openings in said headers for making mechanical position locating contact between said tube and said headers;

at least one of said tubes including a plurality of inwardly projecting turbulator dimples exhibiting a substantially cylindrical portion about a primary axis of heat conduction for creating vortices about the primary axis of heat conduction to reduce boundary heat resistance between the tube and the working fluid:

wherein said tube lateral width is W and the lateral spacing between adjacent dimples is approximately 0.3 W to maximize heat transfer and the dimples are spaced in a longitudinal direction at a spacing of approximately 0.8 W to minimize longitudinal pressure drop.

2. The sealed heat exchanger of claim 1 wherein the dimples are disposed on opposed surfaces of the tubes.

3. The heat exchanger of claim 1 wherein the dimples are disposed in an interleaved opposed relation on opposite sides of the tube.

4. A heat exchanger in claim 1 wherein the dimples are disposed on opposed surfaces of the tubes and opposed dimples are in contact.

5. A heat exchanger in claim 1 wherein the opposed dimples are in contact and brazed together.

6. The heat exchanger of claim 1 wherein the dimples are disposed in an interlaced opposed relation on opposite sides of the tube.

7. The heat exchanger of claim 1 wherein the tube wall has a thickness of 0.014 inches and the dimples exhibit a height in the range of 0.015–0.030 inches.

8. The heat exchanger of claim 1 wherein the tube has a width in the range of 1.5–3 inches and dimples spacing of approximately 0.25–0.5 inches.

9. The heat exchanger of claim 1 wherein the lateral spacing between adjacent dimples is adjusted to achieve agitation to reduce boundary layer thermal resistance and maximize heat transfer.

10. The heat exchanger of claim 1 wherein the tube has a width in the range of 1.5–3 inches and dimples are spaced in a longitudinal direction about 1 inch.

11. The heat exchanger of claim 1 wherein the lateral dimple spacing is selected to maximize heat transfer.

12. A method of cooling a fluid comprising the steps of:

providing a cooling circuit including at least one flattened cooling tube, said cooling tube having a first substantially planar surface and a primary heat transfer axis substantially perpendicular to the planar surface; and providing said cooling tube with an array of inwardly projecting dimples for agitation of fluid flowing through the tube dimples in opposed vortices about the primary heat transfer axis to reduce boundary thermal resistance otherwise occurring at the wall, said tube having a lateral width W and a lateral spacing between adjacent dimples is approximately 0.3 W to maximize heat transfer and the dimples are spaced in a longitudinal direction at a spacing of approximately 0.8 W to minimize longitudinal pressure drop.

* * * * *